United States Patent [19]

Bergmans

[11] Patent Number: 4,481,725

[45] Date of Patent: Nov. 13, 1984

[54] MOCCASIN

[75] Inventor: Charles Bergmans, Sprang Capelle, Netherlands

[73] Assignee: Clarks of England, Inc., Norwalk, Conn.

[21] Appl. No.: 350,749

[22] Filed: Feb. 22, 1982

[51] Int. Cl.[3] ..... A43B 3/14

[52] U.S. Cl. ..... 36/11; 12/142 MC

[58] Field of Search ..... 36/11; 12/142 MC

[56] References Cited

U.S. PATENT DOCUMENTS

| | | | |
|---|---|---|---|
| 2,420,466 | 5/1947 | Cordeau | 36/11 |
| 2,472,265 | 6/1949 | Phillips | 36/11 |
| 2,795,864 | 6/1957 | Giblin | 36/11 |
| 4,161,827 | 7/1979 | Roberts et al. | 36/11 |
| 4,224,747 | 9/1980 | Winfield | 36/11 |
| 4,272,858 | 6/1981 | Hlustik | 36/11 |

FOREIGN PATENT DOCUMENTS

| | | | |
|---|---|---|---|
| 1494675 | 9/1967 | France | 36/11 |
| 419101 | 11/1934 | United Kingdom | 36/11 |

*Primary Examiner*—Werner H. Schroeder

*Assistant Examiner*—Steven N. Meyers

*Attorney, Agent, or Firm*—St. Onge Steward Johnston & Reens

[57] ABSTRACT

An improved moccasin to be worn on a human foot is disclosed. The moccasin comprises a moccasin body including a bottom for underlining the foot, the sole curving upwardly about the sides of the foot in the periphery of the toes to form left and right side walls of the moccasin. The left and right side walls of the moccasin each have a rear portion and the rear portions are secured together and in conjunction with the sole form a heel cup. The heel cup has a generally horizontal sole portion underlining the foot and the sole portion includes an opening defined by an edge extending around this opening. A sole insert is secured in the opening. The insert includes a peripheral edge abutting the opening edge to thereby provide a substantially smooth, continuous upper surface for the foot heel to rest upon. An outer sole, which is preferably formed in a single piece by molding a polymeric material, includes a concave cavity receiving the sole of the moccasin body. The cavity is smoothly contoured to conform the sole to the shape of a human foot.

16 Claims, 11 Drawing Figures

MOCCASIN

BACKGROUND OF THE INVENTION (1) Field of the Invention

The present invention relates to footwear to be worn on a human foot, and, more particularly the present invention relates to a improved moccasin construction.

(2) Description of the Prior Art

A conventional moccasin includes a leather moccasin body for receiving a human foot and an outer sole attached, by stitching or an adhesive or both, to the bottom of the moccasin body. In the manufacture of the moccasin, the leather is cut in a pattern that will eventually form the moccasin body and a vamp is stitched in place to assemble the front part of the moccasin, and the heel portions of the moccasin body are stitched together to form a heel cup. In order to provide a moccasin that can have an outer sole attached thereto, the heel portion of the moccasin body is designed to be substantially flat. In order to produce a flat heel portion, the assembled moccasin body is placed on a conventional last, that is, a block or form shaped like a human foot and used by shoemakers for making moccasins. The last has a generally flat bottom with sides extending generally perpindicularly upwardly from bottom of the last. The curve of the last in the heel portion thereof typically has a small radius. When the leather which forms the sole of the moccasin body is drawn around the heel of the last, the leather tends to bunch, wrinkle and provides a generally discontinuous surface, which surface in its irregular form is not comfortable for a human heel to rest upon. This bunching of the leather in the region of the heel is undesirable for several reasons. Firstly, the process of gathering the leather around the last heel is time consuming and must be done almost entirely by hand. Furthermore, the bunched heel portion of the sole provides a discontinuous and uneven surface upon which a persons heel is to rest. Thus, the bunched leather is often ground down by a grinding device to provide a smooth surface to which the outer sole is attached. Further, the bunching of the leather in the region of the heel is unsightly when viewed from above the shoe and an inner sole must be used to cover the unsightly heel region. The use of an inner sole results in the use of additional leather and further results in the manufacturing process consuming more time because an additional step is necessary to secure the inner sole.

SUMMARY OF THE INVENTION

In accordance with the present invention, an improved moccasin is provided. The moccasin comprises a moccasin body, preferably formed of leather, including a bottom sole underlining the foot. The moccasin body sole curves upwardly above the sides of the foot and the periphery of the toes to form left and right sidewalls of the moccasin. The left and right sidewalls each have a rear portion and the rear portions are secured together, preferably by stitching, to form the moccasin body. The vamp is also stitched in place and forms a portion of the moccasin body.

A heel cup is formed by the rear portions of the left and right sidewalls together with the generally horizontal sole portion that underlines the foot. The sole portion includes an opening defined by an edge extending around the opening. A sole insert is provided and is sized to be received and secured within the opening. The insert includes a peripheral edge that abutts the edge of the opening to thereby provide a substantially smooth, continuous surface for the foot heel to rest upon. The structure wherein the sole insert has an edge that is in abutting relation to the opening has several important advantages. The structure of the heel cup substantially avoids the bunching and irregular surfaces that occur in known moccasin constructions. The insert, which is preferably sewn into the opening, provides for a smooth transition between the generally horizontal sole of the moccasin body and the generally vertical sidewalls in the region where the radius of the heel is small. Moreover, the moccasin construction of the present invention reduces the amount of leather required to make the moccasin body. Further, the construction of the heel cup because of the smooth, uniform surface provided for the foot heel to rest upon, the moccasin is believed to be quite comfortable. A moccasin construction in accordance with the present invention is advantageous because it is simple to construct, and therefore, the method of making the moccasin is relatively simple and efficient, as will be discussed below when the method for making the moccasin is described in detail.

A moccasin in accordance with the present invention also includes an outer sole to provide for wear. The outer sole includes in the top thereof a concave cavity receiving and retaining the sole of the moccasin body. The concave cavity is formed in a reverse image of the typical human foot. When the moccasin body is secured in the cavity, the sole of the moccasin body conforms to the cavity, and, thus is particularly shaped to receive a human foot. In accordance with one aspect of the invention, the outer sole is formed by molding in a single piece. The sole of the moccasin body is attached to the cavity of the outer sole by any suitable means, such as, for example, stitching or use of an adhesive, or use of both stitching and an adhesive.

In the case where the moccasin comprises leather, to reduce the manufacturing costs, it is desired that the leather include a finished exterior surface and have an unfinished interior surface. A piece of leather having only one finished surface is generally less expensive than the same type of leather having both surfaces finished. The insert also includes a finished surface. When the insert is positioned in its opening, the insert faces upwardly so that the finished surface of the insert is visible from above the moccasin. Thus, a person looking into the moccasin will see a finished piece of leather. In one preferred form of the invention, the finished surface of the insert includes thereon printed matter such as a trademark, tradename or other designation such as shoe size. An insert having a finished surface that is exposed provides an asthetically pleasing appearance for the moccasin. In contrast with the prior art moccasins, the use of a separate inner sole is unnecessary. However, a separate inner sole may optionally be used if desired.

In accordance with the present invention, a method for making an improved moccasin is provided. The method comprises forming the moccasin body from sheet material that is preferably leather. The moccasin body is cut in a pattern having a sole and left and right sidewalls. The sole has a heel portion including an opening defined by an edge extending around the opening. A sole insert is also formed and includes a peripheral edge. The insert fits within the opening so that the edge of the opening abutts the peripheral edge of the insert. The various parts of the moccasin body are assembled, that is, the insert is secured in the opening and the rear portion of the sidewalls are secured together to form a heel cup.

In the method of making the improved moccasin, the moccasin body and the insert are positioned on a contoured last that corresponds generally to the shape of the human foot. The last is curved smoothly from its sole portion to its sidewalls in the region of the heel to simulate a human foot. The moccasin body and insert are treated to conform with the last. Preferably, the treating comprises wetting the moccasin body and the insert and allowing the wet moccasin body and insert to dry thereby shrinking the leather and conforming it to the contoured last. In addition, during the treating, it may be desirable to hammer the leather slightly to conform it to the last and to smooth any discontinuities which may exist.

The present invention also includes securing an outer sole to the moccasin body sole. The outer sole includes in the top thereof a concave cavity for receiving and retaining the sole. The cavity is smoothly contoured to thereby conform the sole to the shape of the human foot. The outer sole is secured to the moccasin body by any suitable means such as, for example, applying an adhesive between the moccasin body and the outer sole and assembling the body and the outer sole. In addition, the moccasin body can be secured to the outer sole by stitching.

An improved moccasin in accordance with the present invention is particularly simple in structure and easy to manufacture. The moccasin construction provides a heel cup that has a substantially smooth exposed surface for the foot heel to rest upon. Further, in the method of the present invention, the time consuming task of bunching the leather together at the sole portion of the heel is substantially avoided. Additional advantages of a moccasin in accordance with the present invention will be described in the description of the preferred embodiments of the invention which follows.

DETAILED DESCRIPTION OF THE INVENTION

Figure 1:
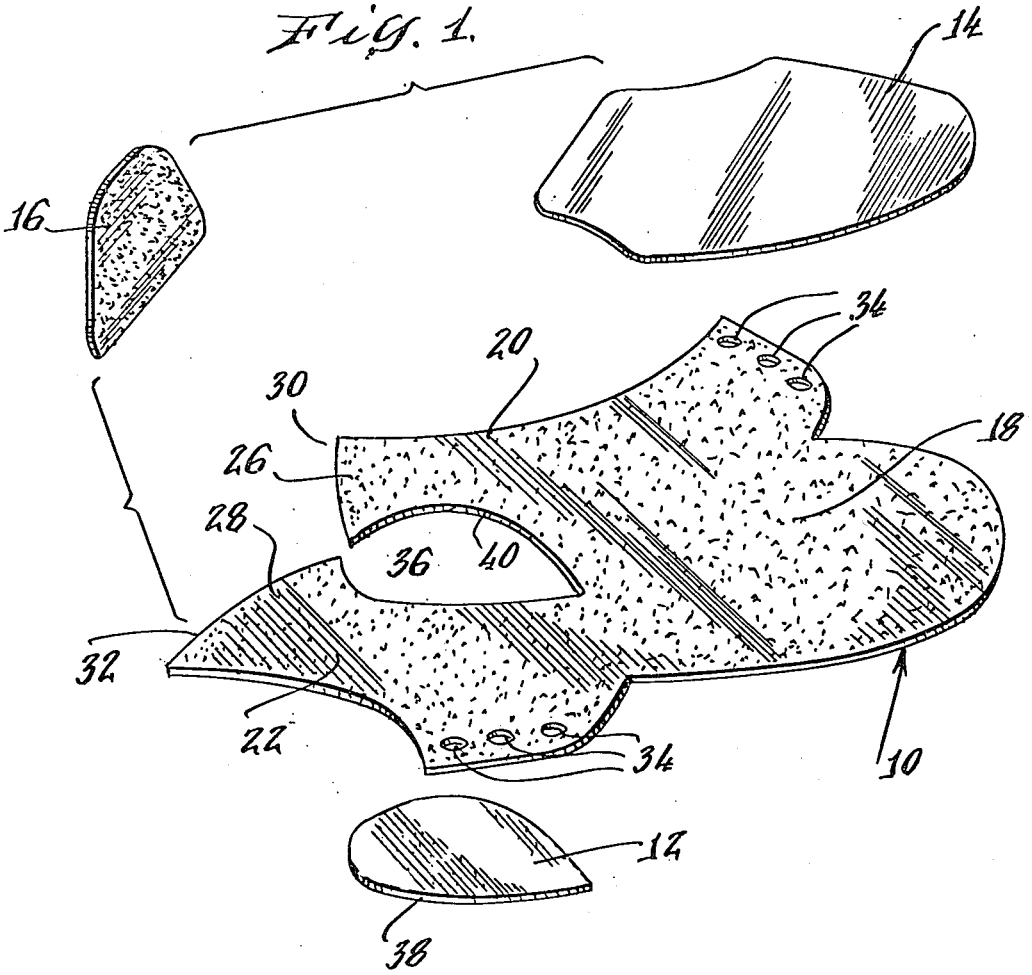
FIG. 1 is an exploded perspective view of the various parts of a moccasin in accordance with the invention with the exception of the outer sole, which is shown in FIG. 6.
Figure 2:
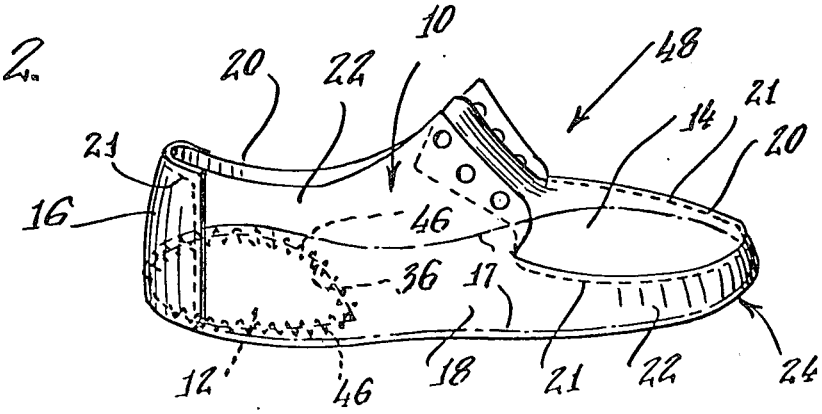
FIG. 2 is a perspective view of a moccasin upper assembled from the parts shown in FIG. 1.

Referring in particular to FIG. 1, the parts of the moccasin upper are shown. The moccasin upper is formed from a moccasin body 10, an insert 12 and a vamp 14, and optionally a heel piece 16 that covers the rear seam between the rear portions of the left and right sidewalls. Referring to FIGS. 1 and 2, the moccasin body 10 includes a sole 18 that smoothly curves upwardly about the sides of a foot and the periphery of the toes to form a left sidewall 20 and a right sidewall 22 (the human foot is not shown). The left and right sidewalls merge at the front portion 24 of the moccasin body. As shown in FIG. 2, the parts of the moccasin upper have been assembled by stitching 21. The phantom line 17 in FIG. 2 is included for the purpose of illustrating the assembled upper 48 in three dimensional form, and does not represent stitching or other structure.

Figure 8:
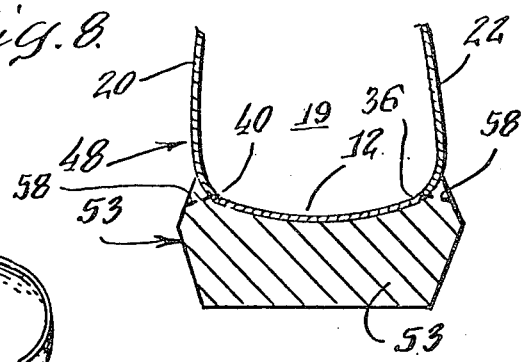
FIG. 8 is a sectional view of the moccasin shown in FIG. 7 along the plane 8—8 thereof.

As shown in FIG. 1, the left sidewall 20 and the right sidewall 22 each have a respective rear portion 26 and 28. The rear portions 26 and 28 of the left and right sidewalls are secured together preferably by stitching, and in conjunction with the sole 18 form a heel cup 19 (see FIGS. 2 and 8). In a preferred form of the invention, rear portion 26 includes an edge 30 and rear portion 28 includes an edge 32. Edges 30 and 32 are positioned in abutting relation and a suitable stitch secures the two rear portions together. The edge to edge abutting relation provides for a smooth seam at the back of the heel. It should be understood, however, a moccasin in accordance with the present invention does not require that the edges be in abutting relation but rather, the rear portions 26 and 28 may overlap and then be stitched together in a suitable fashion.

As shown in FIG. 1, the moccasin body 10 is formed of a single piece of leather. It should be understood, however, that it is often desirable to use two or more pieces of leather to form the moccasin body. These pieces of leather are stitched together to form a pattern of the moccasin body 10. Several pieces of leather may be used to form the moccasin body in an effort to reduce material cost as large pieces of leather are relatively expensive. Moreover, multiple pieces of leather may be used to form an asthetically pleasing outward appearance of the moccasin. As shown in FIGS. 1 through 10 the moccasin includes a plurality of eyelets 34 for receiving laces. It should be understood that the moccasin may be of the laced type, buckle type, or slip-on type, and may have various asthetic designs. As shown in FIG. 1, the interior surface of the body 10 has an unfinished surface (an unfinished surface is shown by stippling in the drawings) whereas, as shown in FIG. 2, the exterior surface has a finished appearance. It should be understood, that it is generally less expensive to produce or purchase leather having one finished side and one unfinished side rather than leather having both sides finished.

Figure 9:
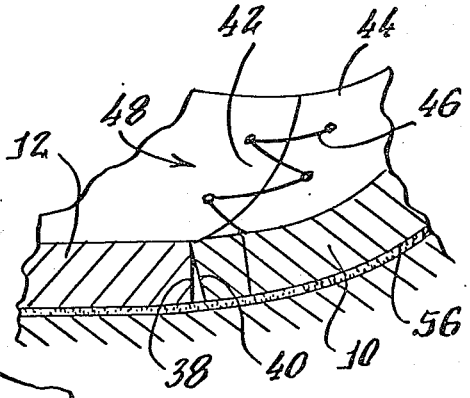
FIG. 9 is a sectional and perspective view along the plane 9—9 of FIG. 7 with only a portion of the outer sole being shown.

Referring to FIGS. 1 and 2, the assembled moccasin upper includes a sole insert 12 for securement in an opening 36 in the moccasin body 10. The insert includes a peripheral edge 38 and the opening 36 is defined by edge 40 extending around the opening. The sole insert is secured within the opening 36 so that peripheral edge 38 abutts the edge 40 of opening 36 to thereby provide a substantially smooth, continuous upper surface. The abutting relation between the edge 38 of the insert 12 and the edge 40 of the opening 36 is best shown in FIG. 9, which is a view of the moccasin after it has been assembled with an outer sole. As shown in FIG. 9, the edges 38 and 40 are in partial abuttment. Over the entire length of the circumference of opening 36, the amount of abuttment may vary. However, the upper surface 42 of insert 12 is generally level with the upper surface 44 of moccasin body 10 to provide a smooth, continuous surface for the foot heel to rest upon. As shown in FIG. 9, the edges 38 and 40 are secured together by stitching 46 that runs about the circumference of opening 40. As can be appreciated by viewing FIG. 9, the stitching 46 between the insert 12 and the moccasin body 10 enables the two pieces to be assembled together without substantial bunching of the leather. Thus, in the portion of the heel that has a relatively small radius, r (see FIG. 3), bunching of the leather can be substantially avoided with the use of the stitching 46 which provides a smooth transition between the vertical sidewalls 20 and 22 of the generally horizontal insert 12.

As shown in FIG. 9, the edge 40 is generally perpendicular to the surface 44, and, likewise, edge 38 is generally perpendicular to surface 42. It should be understood that the leather of the insert 12 and the moccasin body 10 may be cut to provide edges 38 and 40 that are at angles other than perpendicular with respect to their respective surfaces 42 and 44. For example, edge 40 may be cut at an angle of 60 degrees with respect to surface 44 and edge 38 may be cut at an angle of 120 degrees with respect to surface 42. When the edges are placed in abutting relation, a smooth, continuous upper surface is provided.

Figure 3:
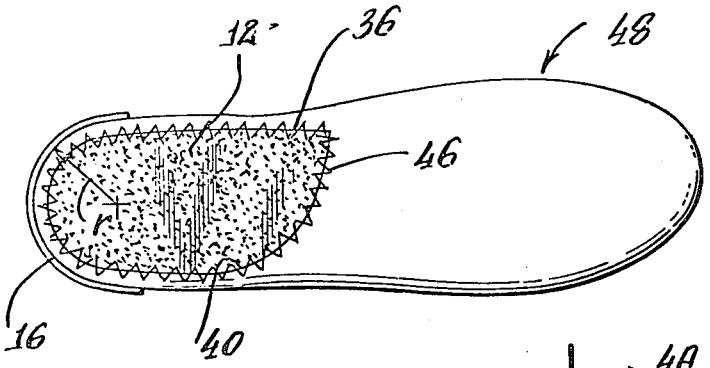
FIG. 3 is a bottom plan view of the assembled moccasin upper shown in FIG. 2.
Figure 4:
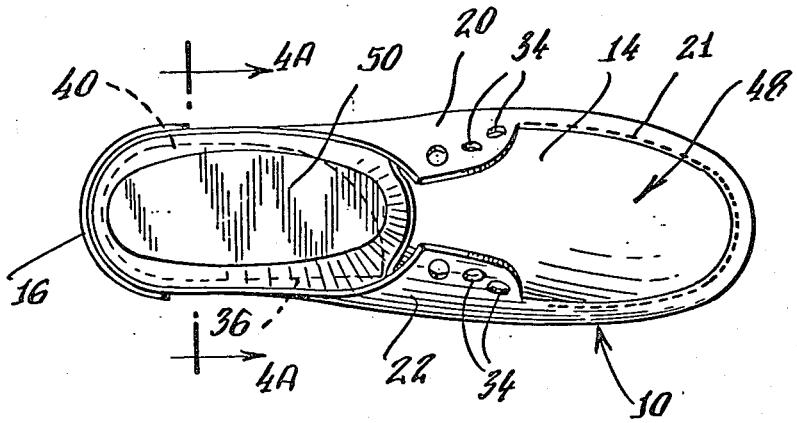
FIG. 4 is a top plan view of the assembled moccasin body after a last has been fit therein.
Figure 5:
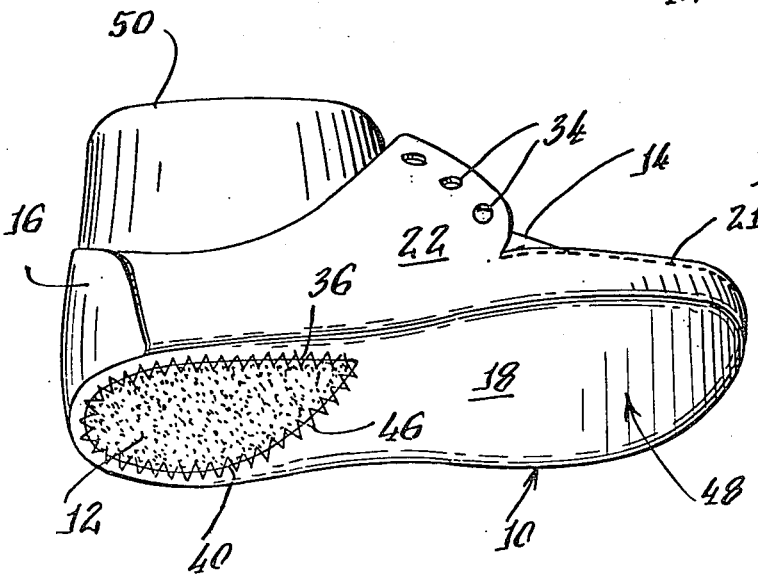
FIG. 5 is perspective bottom view of the assembled moccasin upper shown in FIG. 4.
Figure 4A:
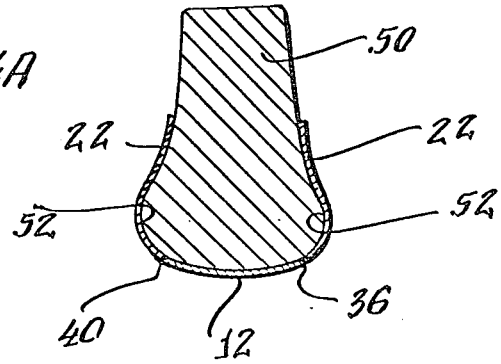
FIG. 4*a* is a sectional view of the last along the plane 4*a*—4*a* of FIG. 4.

As shown in FIG. 2, the various components of the moccasin upper, that is, the moccasin body 10, the insert 12, the vamp 14, the optional heel piece 16 are assembled together to form a moccasin upper shown generally at reference character 48 of FIG. 2. Referring to FIGS. 3, 4 and 5, the upper 48 is positioned on a last that has the general shape of a human foot. As shown particularly well in FIG. 4A, which is a sectional view of the last along the plane 4A—4A of FIG. 4, the last has smoothly rounded heel portion 52 that has a shape similar to the shape of a human foot. The use of a contoured last in the manufacture of a moccasin is particularly suitable with the construction of the present invention to provide a smoothly contoured moccasin upper 48.

Once the moccasin upper 48 has been positioned on last 50, it is treated by wetting the leather and allowing the leather to shrink to conform generally to the shape of the last. In addition, in order to smooth out irregularities which may occur around the heel, a hammer or other means may be used to shape the moccasin upper.

Figure 6:
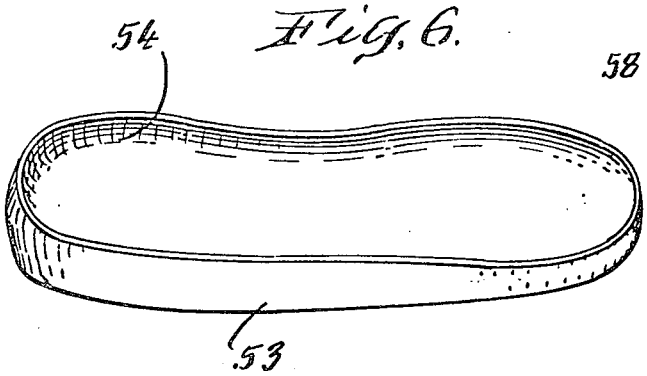
FIG. 6 is a perspective top view of an outer sole for use with the moccasin upper shown in FIGS. 1 through 5.

After the moccasin upper 48 has been formed to the desired shape, it is then ready for attachment to an outer sole of the type shown in FIG. 6. Referring to FIG. 6, the outer sole includes in the top thereof a concave cavity 54. The cavity 54 is smoothly contoured in the reverse image of a human foot. When the moccasin upper described above is secured in the cavity, the cavity conforms generally the sole of the moccasin upper to the shape of a human foot thereby making the moccasin quite comfortable. The outer sole 53 is preferably molded from a polymeric material such as synthetic or natural rubbers, polyurethane, ethyl vinyl acetate, and various other polymer materials and mixtures of polymeric materials that are suitable for use as an outer sole. It is preferred that the outer sole 53 be formed in a single piece to provide a more efficient manufacturing operation. However, it should be understood that many various types of materials commonly used to form a moccasin outer sole may be used, including, but not limited to, leather, leather and plastic laminates, leather and metal laminates.

Figure 10:
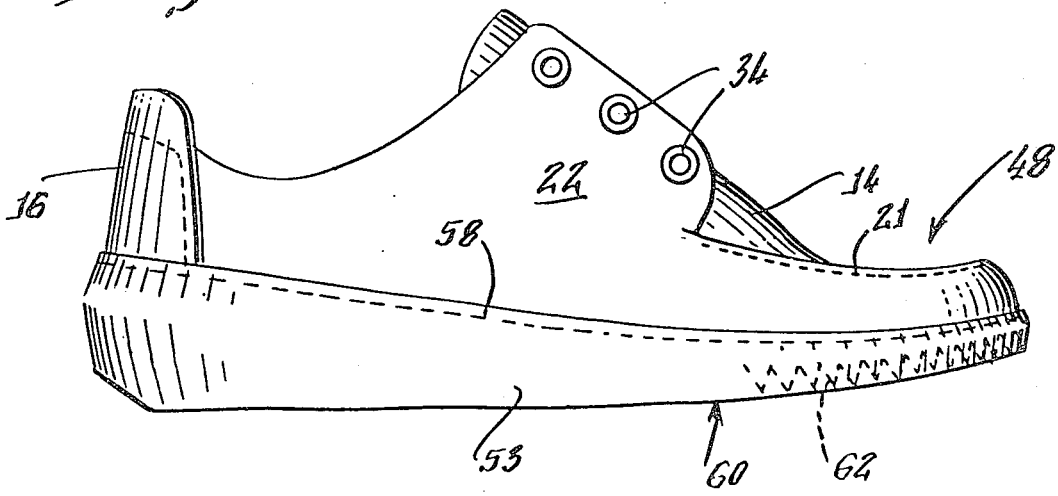
FIG. 10 is a side view of the moccasin shown in FIG. 7.

Referring to FIGS. 7, 8, 9 and 10, the moccasin upper 48 is secured to the outer sole 53 by the use of a suitable adhesive 56 (see FIG. 9) that is positioned between the cavity 54 and the bottom of moccasin upper 48. Any suitable type of adhesive for use in footwear may be used and many types of conventional adhesives are readily available. In addition, as shown in FIG. 10, the periphery of the outer sole 53 may be stitched with stitching 58 to the moccasin upper 48. As shown in FIG. 10, the stitching 58 is positioned along the sidewalls 22 and 20. However, it should be understood that stitching between the bottom sole 60 and the moccasin upper 48 may be used. In this instance, the stitching 62, as shown in FIG. 10, may be directed downwardly through the sole of the moccasin upper 48 into the outer sole 53. It should be understood that a moccasin in accordance with the present invention is not limited to a particular way in which the outer sole is secured to the moccasin upper, and various conventional methods of attaching the outer sole may be used.

Figure 7:
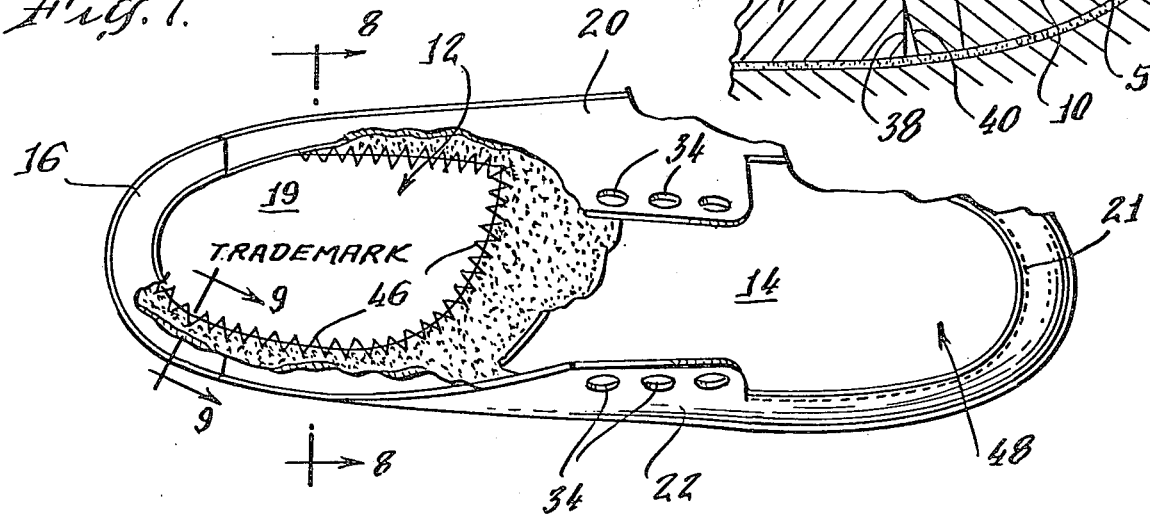
FIG. 7 is a top plan view of the moccasin formed from an assembled moccasin upper and outer sole.

As shown in FIG. 7, the insert 12 includes a finished surface. The finished surface faces upwardly so that it is in clear view through from above. The finished surface of the insert 12 may have several types of designations, printed, embossed or in other ways positioned on the surface thereof. As shown in FIG. 7, the words "TRADEMARK" are shown on the surface of the insert 12 to illustrate a typical type of designation. Thus, the moccasin can be labeled without the use of an additional insole having the printed matter thereon.

It should be understood that the structure of the present invention allows the manufacturer to avoid completely the use of an insole as is conventionally used in the prior art. The avoidance of an insole reduces the material required and also shortens the manufacturing process. It should be understood, however, that if an insole is desired for either asthetic or comfort purposes or other purposes, an insole may be placed in the moccasin of the present invention.

It should be understood that although specific embodiments of the invention have been described herein in detail, such description is for purposes of illustration only and modifications may be made thereto by those skilled in the art within the scope of the invention.

What is claimed is:

1. An improved moccasin to be worn on a human foot, the moccasin comprising:

a moccasin body including a bottom sole for underlining said foot, said sole curving upwardly about the sides of said foot and the periphery of said toes to form left and right sidewalls of said moccasin, said left and right vertical sidewalls each having a rear portion, said rear portions being secured together, and in conjunction with said sole forming a heel cup, said heel cup having a generally horizontal sole portion for underlying said foot, said sole portion including an opening defined by an edge extending around said opening;

a horizontal sole insert secured in said opening, said insert including a peripheral edge abutting said opening edge to thereby provide a substantially smooth, continuous upper surface for the foot heel to rest upon and a smooth continuous transition between said horizontal sole inset and said vertical left and right sidewalls, said abutting of said peripheral edge and said opening edge located closely adjacent said horizontal to vertical transition in said heel cup; and an outer sole secured to said moccasin body, said outer sole including in the top thereof a concave cavity receiving and retaining said sole of said moccasin body, said cavity being smoothly contoured to thereby conform generally said sole to the shape of said human foot.

2. An improved moccasin according to claim 1 wherein said moccasin body comprises leather and includes a finished exterior surface and an unfinished interior surface and wherein said insert comprises leather and includes a finished surface, said finished surface of said insert facing upwardly so that said finished surface of said insert is visible from above said moccasin.

3. An improved moccasin according to claim 2 wherein said moccasin body is secured to said outer sole by an adhesive.

4. An improved moccasin according to claim 3 wherein said outer sole includes a periphery and further including stitching between said outer sole periphery and said moccasin body.

5. An improved moccasin according to claim 1 and further including stitching for securing said peripheral edge of sole insert with respect to said edge of said opening, said stitching extending around the entire peripheral edge of said insert.

6. An improved moccasin according to claim 2 wherein said insert includes an unfinished surface and wherein said unfinished surface of said insert faces downwardly.

7. An improved moccasin construction according to claim 6 wherein said finished surface of said insert includes thereon printed matter.

8. An improved moccasin according to claim 6 wherein said rear portions of said left and right sidewalls each include a terminal edge, said terminal edges being positioned in abutting relation and being secured with respect to each other by heel stitching.

9. An improved moccasin according to claim 8 and further including a heel piece covering said heel stitching, said heel piece including a periphery, said heel piece being secured to said moccasin body by stitching along the periphery of said heel piece.

10. A moccasin according to claim 1 wherein said outer sole comprises a unitary body of polymeric material.

11. A moccasin according to claim 10 wherein said outer sole material comprises molded rubber.

12. A method for making an improved moccasin to be worn on a human foot, the method comprising:

forming a moccasin body from sheet material, said moccasin body having a sole and vertical left and right sidewalls, said sole having a heel portion and including an opening defined by an edge extending around said opening, and a horizontal sole insert including a peripheral edge, said insert for fitting within said opening, said edge of said opening abutting said peripheral edge of said insert to thereby provide a substantially smooth, continuous surface for the heel to rest upon and a smooth transition between said sole insert and said left and right sidewalls, said left and right sidewalls each having a rear portion, said abutting of said peripheral edge and said opening edge located closely adjacent said horizontal to vertical transition in said heel in said heel portion;

assembling the moccasin body and the insert by securing said insert in said opening and said rear portions of said sidewalls;

treating said moccasin body and said insert to conform it to a last that corresponds generally to the shape of the human foot, said last having a heel being curved smoothly from its sole portion to its sidewalls region of its heel; and securing an outer sole to said sole of said moccasin body, said outer sole including in the top thereof a concave cavity, said cavity receiving said sole of said moccasin body, said cavity being smoothly contoured to thereby conform generally said sole to the shape of the human foot.

13. A method according to claim 12 wherein said assembling step comprises stitching said insert within said opening and stitching together the rear portions of the left and right sidewalls.

14. A method according to claim 13 wherein said sheet material comprises leather and wherein said step of treating comprises wetting said moccasin body and said insert and allowing said wet moccasin body and insert to dry thereby shrinking said moccasin body and said insert and conforming them to said contoured last.

15. A method according to claim 14 wherein said step of securing said sole of said moccasin body to said outer sole comprises applying an adhesive between said sole and said outer sole.

16. A method according to claim 15 wherein said step of securing further comprises stitching said outer sole to said moccasin body.

* * * * *